US006398492B1

(12) United States Patent
Cho et al.

(10) Patent No.: US 6,398,492 B1
(45) Date of Patent: Jun. 4, 2002

(54) AIRFLOW GUIDE STATOR VANE FOR AXIAL FLOW FAN AND SHROUDED AXIAL FLOW FAN ASSEMBLY HAVING SUCH AIRFLOW GUIDE STATOR VANES

(75) Inventors: Kyung Seok Cho; Ok Ryul Min, both of Taejon-si (KR)

(73) Assignee: Halla Climate Control Corp., Taejon (KR)

( * ) Notice: Subject to any disclaimer, the term of this patent is extended or adjusted under 35 U.S.C. 154(b) by 0 days.

(21) Appl. No.: 09/475,396

(22) Filed: Dec. 30, 1999

(30) Foreign Application Priority Data

Dec. 31, 1998 (KR) ..... 88-0064132

(51) Int. Cl.[7] ..... F04D 29/54

(52) U.S. Cl. ..... 415/191; 415/211.2; 415/228; 416/169 A; 416/189

(58) Field of Search ..... 415/191, 192, 415/209.2, 211.2, 220, 222, 228; 416/169 A, 189

(56) References Cited

U.S. PATENT DOCUMENTS 4,219,325 A * 8/1980 Gutzwiller ..... 432/199
5,758,716 A * 6/1998 Shibata ..... 165/41
5,996,685 A * 12/1999 Alizadeh ..... 165/121
6,024,536 A * 2/2000 Tsubakida et al. ..... 416/189
6,142,733 A * 11/2000 Alizadeh et al. ..... 415/208.2

* cited by examiner

*Primary Examiner*—Edward K. Look
*Assistant Examiner*—Ninh Nguyen
(74) *Attorney, Agent, or Firm*—Knobbe Martens Olson & Bear LLP

(57) ABSTRACT

An airflow guide stator vane for an axial flow fan and a shrouded axial flow fan assembly having such stator vanes are disclosed. The airflow guide stator vane has a leading edge line, a trailing edge line, and an airflow guide surface extending from the leading edge line to the trailing edge line. The stator vane is radially positioned in an axial flow fan and is curved so that its leading edge line is perpendicular to oblique velocity components of an airflow each of which is a sum vector of a rotation-directional velocity component and a radius-directional component of an air particle of the airflow. The axial flow fan assembly comprises an axial flow fan and a shroud. The axial flow fan consists of a circular central hub connected with a driving shaft of a motor and a plurality of blades radially arranged along the circumference of the hub. The shroud consists of a housing surrounding the peripheral ends of said axial flow fan and forming an airflow passage, a motor support being positioned at its center portion and holding a motor for driving said axial flow fan, and the above-described stator vanes.

8 Claims, 17 Drawing Sheets

AIRFLOW GUIDE STATOR VANE FOR AXIAL FLOW FAN AND SHROUDED AXIAL FLOW FAN ASSEMBLY HAVING SUCH AIRFLOW GUIDE STATOR VANES

BACKGROUND OF THE INVENTION

1. Field of the Invention

The present invention relates, in general, to axial flow fans and, more particularly, to an airflow guide stator vane for an axial flow fan capable of guiding air having dimensional velocity components along the axial direction, and a shrouded axial flow fan assembly having such airflow guide stator vanes.

2. Description of the Prior Art

As well known to those skilled in the art, an axial flow fan is a kind of fluid machinery and serves to blow air in the axial direction by the rotation of a plurality of radially arranged blades. Generally, the axial flow fan is used in conjunction with a shroud, the shroud surrounding the blades and guiding air toward the axial direction.

Such a shrouded axial flow fan assembly is used to ventilate a room and promote the heat radiation of an air-cooled heat exchanger, such as a radiator or a condenser of an automobile. The shrouded axial flow fan assembly may promote heat radiation by blowing air to or drawing air from the heat exchanger.

The shrouded axial flow fan may be classified into a pusher-type axial flow fan assembly and a puller-type axial flow fan assembly. The pusher-type axial flow fan assembly serves to blow air from a position in front of a heat exchanger to a position behind the heat exchanger. Since such a pusher-type axial flow fan assembly has a low blowing efficiency, it is used only when the space, formed behind the heat exchanger in an engine room, is significantly limited. The puller-type axial flow fan assembly serves to allow air to pass through the heat exchanger by drawing air from a position in front of the heat exchanger to a position behind the heat exchanger. Since such a puller-type axial flow fan assembly has a high blowing efficiency, it is used in most automobiles, recently.

Meanwhile, in the shrouded axial flow fan assembly, the shroud of the fan assembly may have a plurality of airflow guide stator vanes so as to improve a blowing efficiency. The airflow guide stator vanes are radially arranged around a center portion with the center of the center portion lying on the central axis of the fan assembly. The airflow guide stator vanes serve to improve static pressure by converting the kinetic energy of the air blown by the blades of the fan to the pressure energy of the air, thus improving the blowing efficiency of the fan.

FIG. 1 is a rear view showing a conventional puller-type shrouded axial flow fan assembly provided with airflow guide stator vanes.

As shown in FIG. 1, the axial flow fan assembly comprises an axial flow fan 10 and a shroud 30.

The axial flow fan 10 consists of a central hub (not shown in the drawing) connected with the driving shaft of a motor (not shown) and a plurality of blades 12 extending radially outwardly from the hub. The axial flow fan 10 is mounted in the rear of a heat exchanger, and serves to draw air from the front of the heat exchanger, pass the air through the heat exchanger and discharge the air to the rear of the axial flow fan 10. In the process of the movement of the air, the heat exchanger is deprived of heat by the drawn air and is cooled. The axial flow fan is generally made of synthetic resin and integrated with the blades 12 into a single body.

The shroud 30 surrounds the blades 12 and is fixed to the heat exchanger. The shroud 30 serves to guide air drawn by the axial flow fan to the rear and to support the axial flow fan 10 and a motor 10. The shroud 10 consists of a rectangular housing 31, a motor support 32 positioned in the center portion of a plane and a plurality of airflow guide stator vanes 33 arranged radially between the housing 31 and the motor sport 32.

The housing 31 has an inlet opened toward the face of the heat exchanger and has a flaring airflow guide structure gradually diminished to its outlet. Its airflow guide structure allows the heat exchanger to be cooled sufficiently and blows air along the axial direction, thus improving the efficiency of the fan. The housing 31 is provided at its upper and lower portions with mounting brackets 34 that are used to mount the housing 31 to the heat exchanger by bolts.

The stator vanes 33 extend radially from the housing 31 to the motor support 32 and connect the motor support 32 to the housing 31. Additionally, as shown in FIG. 2, each of the stator vanes is arcuated toward the direction of rotation and forms a guide surface 33*a* having a certain width, thus guiding air moved by the axial flow fan 10 toward the axial direction and improving the blowing efficiency of the fan.

The motor support 32 holds the axial flow fan 10 and a motor 20 for driving the axial flow fan 10. The motor support 32 is circular band-shaped in accordance with the shape of the hub of the axial flow fan 10 and the shape of the motor 20.

In the shrouded axial flow fan assembly, as shown in FIG. 1, the stator vanes 33 are extended straightly from the circumference of the motor support 32 to the housing 31, and, as shown in FIG. 2, the airflow guide surface 33*a* of each of the stator vanes is arcuated so that one end side of the surface 33*a* forms an angle θt with the axial line A.L. The stator vanes 33 serve to increase the axis-directional velocity by converting the rotation-directional velocity component to the axis-directional velocity component, thus improving the blowing efficiency of the fan. That is, since airflow generated by the axial flow fan 10 has the rotation-directional velocity component $U_{th}$ as well as the axis-directional velocity component $U_z$ and the blowing efficiency of the fan is reduced when the rotation-directional velocity component $U_{th}$ is left alone, the axis-directional velocity is increased by converting the rotation-directional velocity component to the axis-directional velocity component, so that the blowing efficiency of the fan is improved.

The function of the airflow guide surface 33*a* of the airflow guide state vanes is described in more detail in the following.

In the airflow field inside of the housing 31, an air particle is moved to the direction curved toward the direction of rotation and the radial direction. That is, as shown in FIG. 2, since the air particle, passing through the position spaced apart from the axial line of the axial flow fan by a distance r along the radial direction, has a rotation-directional velocity component $U_{th}$ generated by the rotation of the blades 12 of the axial flow fan 10 as well as an axis-directional velocity component $U_z$, the air particle is moved toward the leading edge 33*b* of the stator vane 33 in the direction that is bent to the direction of rotation at $\theta_T$ with respect to the axial direction. Under the consideration of the actual airflow direction, the airflow guide surface 33*a* of each stator vane 33 is arcuated so that the leading edge side of the guide surface 33*a* forms an oblique angle $\theta_t$ ($\theta_t \leqq \theta_T$) with the axial line A.L. Therefore, the guide surface 33*a* reflects the air having oblique flow direction toward the axial direction and, thus, increases the axis-directional velocity. As a result, the blowing efficiency of the fan is improved due to the increase of the axis-directional velocity.

U.S. Pat. No. 4,548,548 discloses a fan and housing wherein the oblique angle of the airflow guide surface of each stator vane is defined with respect to the axial line so as to improve the blowing efficiency of the fan. The velocity vector $A_D$ of air at the position, which is spaced apart from the central line of rotation by a distance r in the field of airflow, has both an axis-directional velocity component A and a rotation-directional velocity component R. The velocity vector $A_D$ forms an oblique angle T of $Tan^{-1}(R/A)$ with the axial line. Each vane of the fan is positioned so that the width-directional tangent at the center of its width forms an angle T/2 with a line parallel to the airflow discharge direction with the airflow guide surface of each vane of the fan being arcuated in its cross section. Therefore, the guide surface receives the air at the oblique angle T/2 and, thereafter, reflects axially at the angle T/2. As a result, the axis-directional velocity component is increased in proportion to the axially reflected rotation-directional velocity, thereby improving the airflow rate of the fan to the extent proportional to the axially reflected rotation-directional velocity.

In U.S. Pat. No. 4,971,143, there is disclosed a fan stator assembly for heat exchangers wherein a plurality of vanes extend radially from a motor support to a housing, with the leading edge side of each stator vane being oriented parallel to the direction of an entering air flow and the trailing edge side of each stator vane being oriented to be parallel to an axial line. The fan stator assembly suppresses the generation of vortices at the airflow guide surface of the vane to curve the airflow smoothly, thereby improving the blowing efficiency of the axial flow fan.

However, since the conventional axial flow fan assemblies including the shrouded axial flow fan assembly described in FIG. 1, the fan and housing described in U.S. Pat. No. 4,548,548 and the fan stator assembly for heat exchanger described in U.S. Pat. No. 4,971,143 are designed without the consideration of the radius-directional component of air, they have a limitation in the improvement of blowing efficiency. As shown in FIG. 7, since the conventional axial flow fan assemblies control only the axis-directional velocity component $U_z$ and the rotation-directional velocity component $U_{th}$ except the radius-directional velocity component $U_r$ notwithstanding that the air moved by the axial flow fan must have the radius-directional velocity component $U_r$ as well as the axis-directional velocity component $U_z$ and the rotation-directional velocity component $U_{th}$, the blowing efficiency is low due to the existence of the radius-directional velocity component. Therefore, since the axial flow fan of the conventional shrouded axial flow fan assembly should be highly rotated so as to obtain a required airflow rate, a high power motor is required in the fan assembly. As a result, the conventional axial flow fan assemblies have defects in that their consumed electric power per required airflow rate and the noise of the fan assemblies are increased.

SUMMARY OF THE INVENTION

Accordingly, the present invention has been made keeping in mind the above problems occurring in the prior art, and an object of the present invention is to provide an airflow guide stator vane for axial flow fans and a shrouded axial flow fan assembly having such airflow guide stator vanes, capable of improving the blowing efficiency by converting the radius-directional velocity components as well as the rotation-directional velocity components of airflow generated by an axial flow fan to the axis-directional velocity components by its airflow guide surface, thus allowing a low output motor to be used for the fan and reducing the consumed power for driving the axial flow fan and noise generated by the driving of the axial flow fan.

In order to accomplish the above object, the present invention provides an airflow guide stator vane comprising a leading edge line, a trailing edge line, and an airflow guide surface extending from the leading edge line to the trailing edge line, the stator vane being radially positioned in an axial flow fan and being curved so that its leading edge line is perpendicular to oblique velocity components of an airflow each of which is a sum vector of a rotation-directional velocity component and a radius-directional component of an air particle of the airflow.

In addition, the present invention provides an axial flow fan assembly, comprising an axial flow fan consisting of a circular central hub connected with a driving shaft of a motor and a plurality of blades radially arranged along the circumference of the hub; and a shroud consisting of a housing surrounding the peripheral ends of said axial flow fan and forming an airflow passage, a motor support being positioned at its center portion and holding a motor for driving said axial flow fan, and a plurality of airflow guide stator vanes being radially arranged between said housing and said motor support and being curved so that its leading edge line is perpendicular to oblique velocity components of an airflow each of which is a sum vector of a rotation-directional velocity component and a radius-directional component of an air particle of the airflow.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
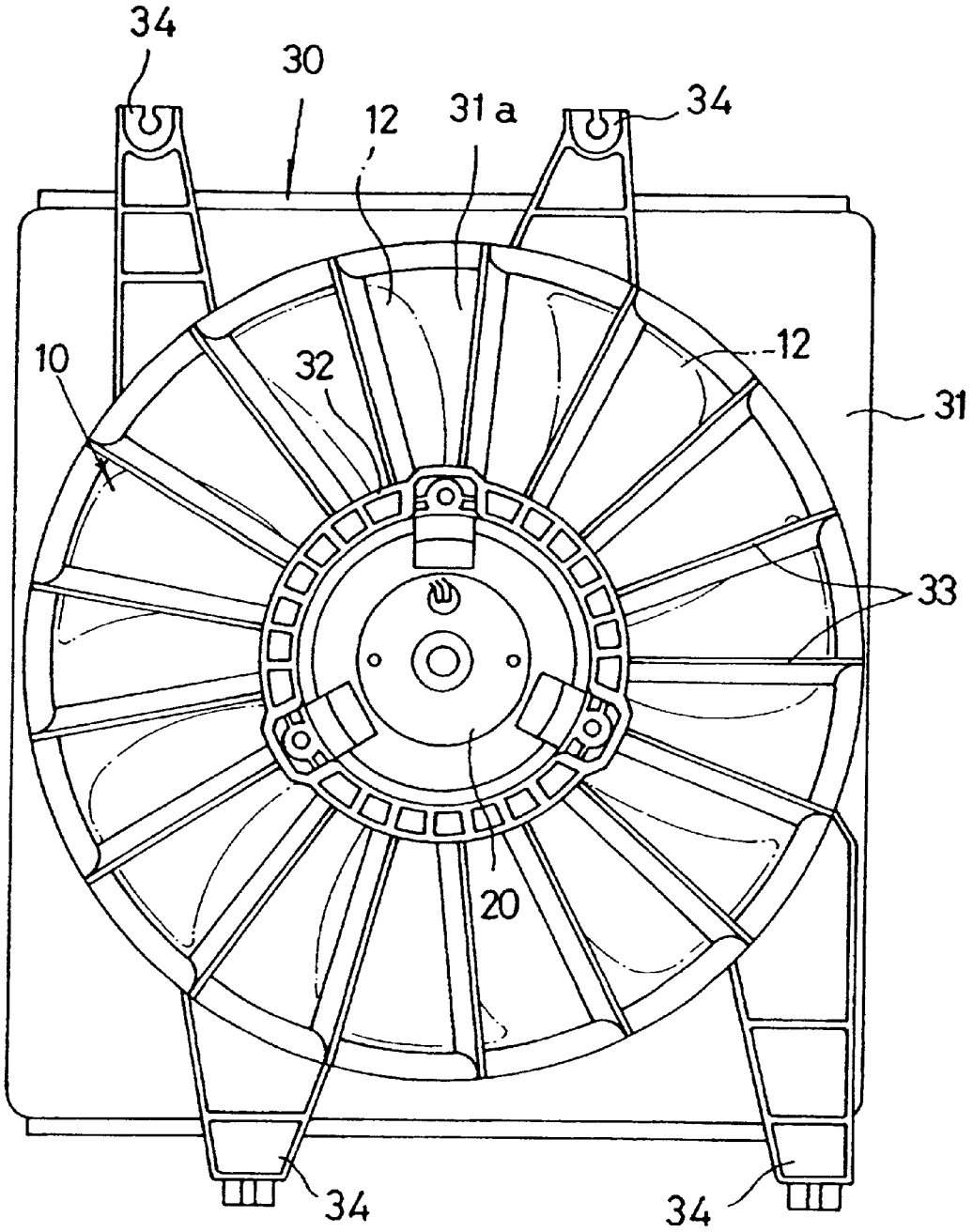
Fig. 1 PRIOR ART
FIG. 1 is a rear view showing a conventional puller-type shrouded axial flow fan assembly provided with a plurality of airflow guide stator vanes.
Figure 2:
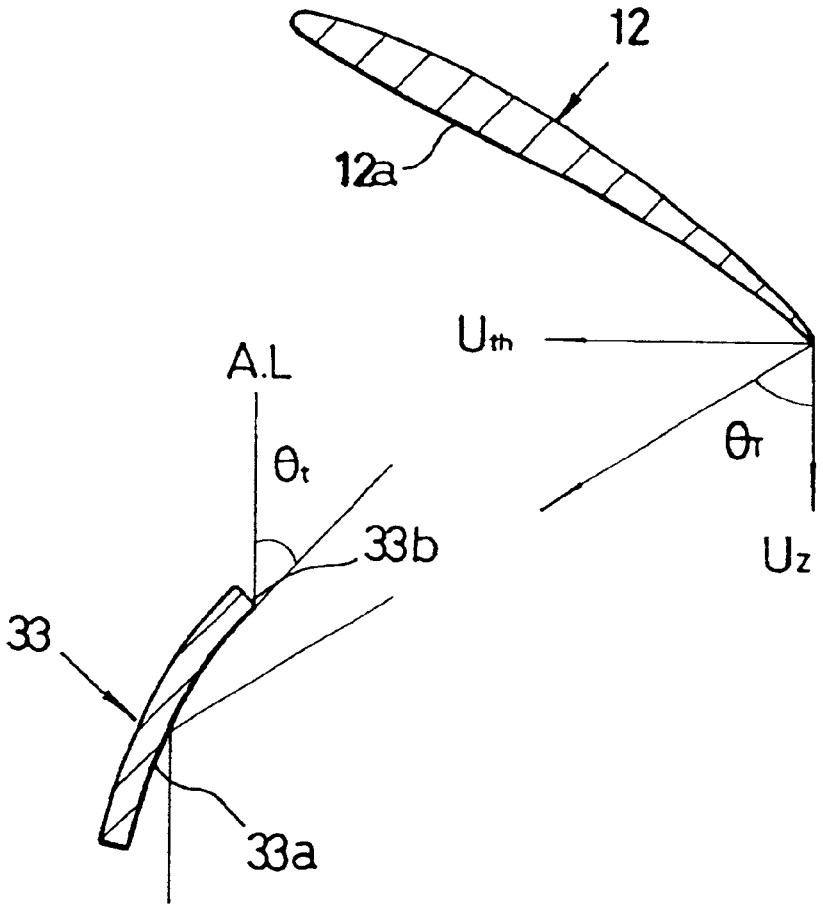
Fig. 2 PRIOR ART
FIG. 2 is a cross section showing the vane and blade of the conventional fan assembly.

For ease of description, the description on the same elements as those of the prior art is omitted and the same elements as those of the prior art are designated by the same reference characters as the reference characters of the prior art.

Additionally, the flow of an air particle, which is a basic datum for the design of stator vanes according to the present invention, is varied at positions in an air passage due to the resistance of a shroud housing, a heat exchanger, the shape of an automobile body, etc. that affect airflow.

However, in the practical design of stator vanes according to the present invention, it is convenient to assume that the mean velocity is uniformly continued along the radial direction, the mean velocities with respect to the radial distances being calculated from the velocities of air at various positions equally spaced apart from the central axis of a wind tunnel obtained from wind tunnel tests, etc. That is, in the practical design, it is assumed that in spite of the difference in resistance generated by factors including the shroud housing, the heat exchanger, the shape of the automobile body, etc., the air, which is moved by an axial flow fan, flows at the same relative velocity at positions situated on the concentric circle within the air passage when viewed from the basis of a polar coordinate system that has an origin in the central axis of the air passage.

[EMBODIMENT 1]

Figure 3:
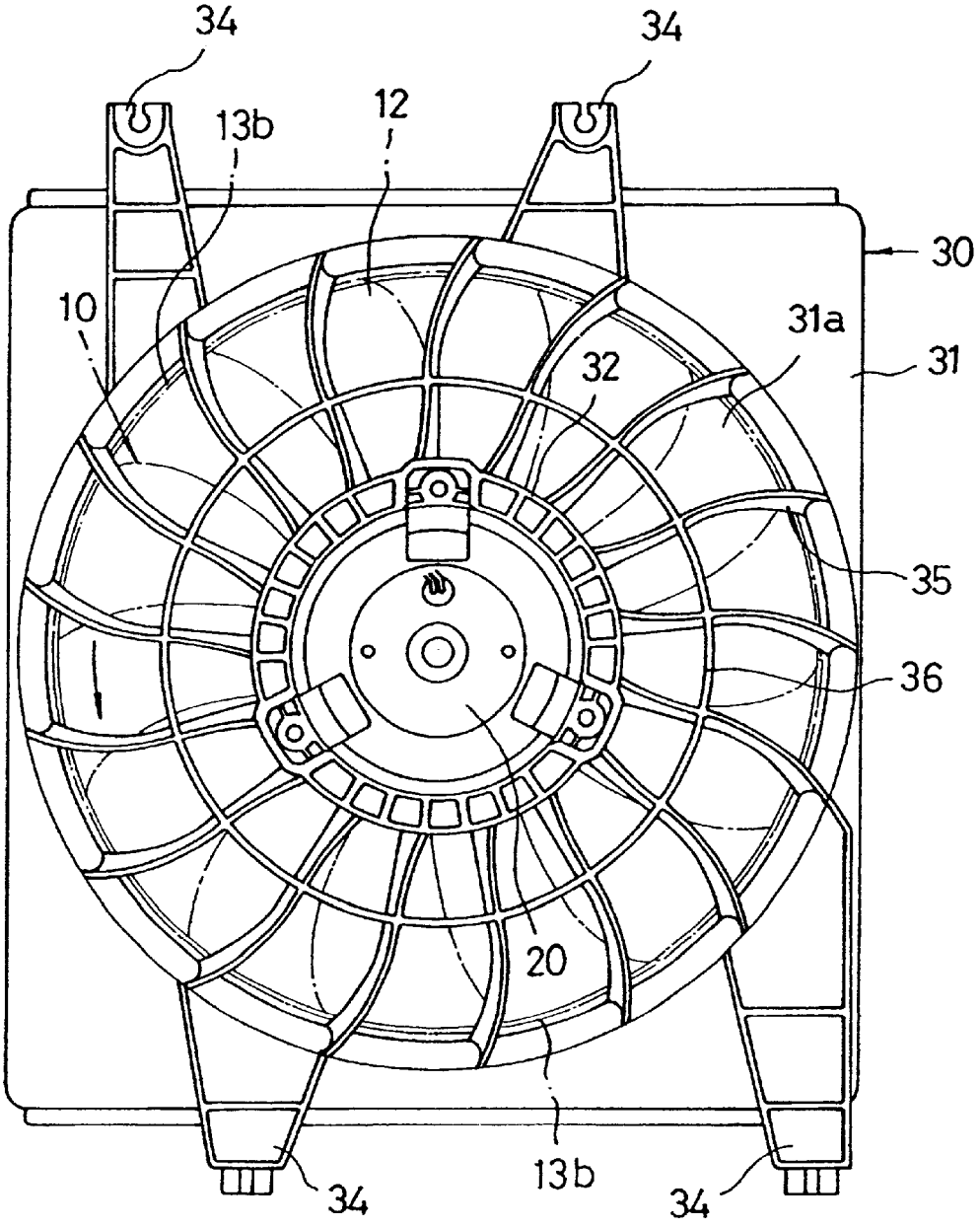
FIG. 3 is a rear view showing a shrouded axial flow fan assembly according to a first embodiment of the present invention.
Figure 4:
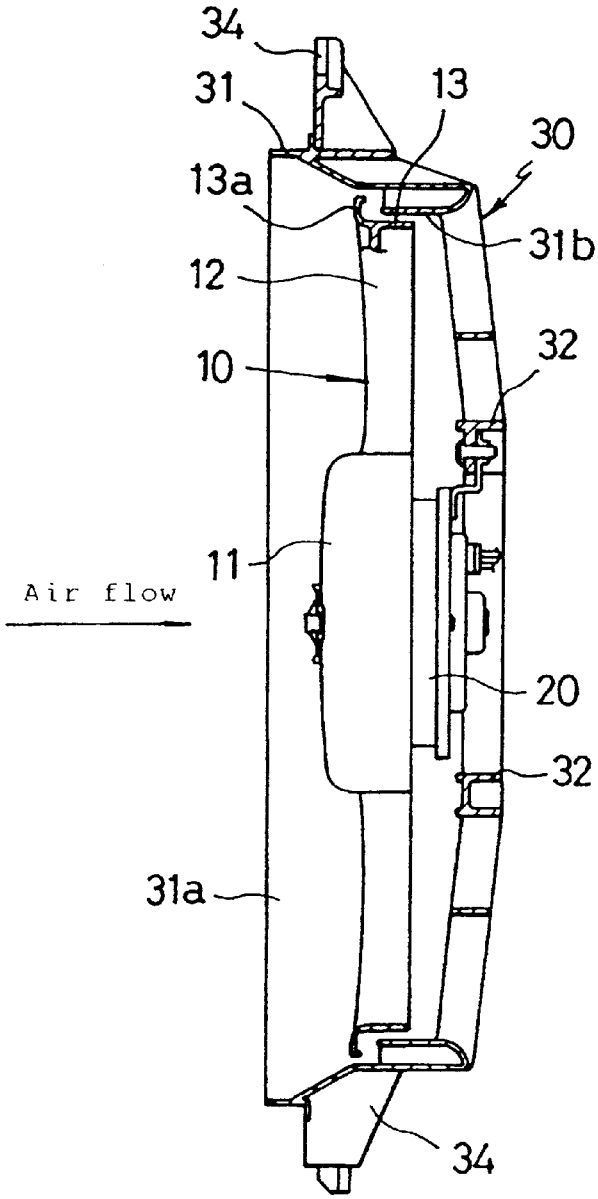
FIG. 4 is the side cross section of FIG. 3.

As shown in FIGS. 3 and 4, an axial flow fan assembly according to Embodiment 1 comprises an axial flow fan 10 and a shroud 30.

In this embodiment, the axial flow fan 10 consists of a circular central hub 11 positioned at its center portion and a plurality of blades 12 radially arranged along the 30 circumference of the hub 11. The shroud 10 consists of a motor support 32 holding the axial flow fan 10 and a motor 20 for driving the axial flow fan 10, a plurality of airflow guide stator vanes 33 radially arranged along the circumference of the motor support 32, and a rectangular housing 31 surrounding the peripheral ends of the axial flow fan 10 and the stator vanes 33.

In the axial flow fan 10 of this embodiment, the central hub 11 is connected with the driving shaft of a motor 20. The blades 12 are radially arranged along the circumference of the hub 11, are rotated together with the hub 11 and generate airflow. Incidentally, the axial flow fan 10 may be provided with an outer band 13 to which the peripheral ends of the blades 12 are fixed and which improves the blowing efficiency of the fan by suppressing the generation of vortices at the peripheral ends of the blades 12. The axial flow fan is generally made of synthetic resin and formed into a single body. However, the axial flow fan is sometimes made of lightweight aluminum. The outer band 13 shown in FIG. 4 has a flaring mouth like a bell mouth and covers an air guide portion 31*b* extended from the downstream end of the housing 31 toward the upstream direction, so as to maximizing its function.

In the shroud 30 of this embodiment, the housing 31 has a rectangular shape in accordance with the shape of a heat exchanger so as to cover the entire face of the heat exchanger, is projected at its upstream side end toward the upstream direction so as to ensure the space for airflow, and has a bell mouth-shaped cross section that grows smaller toward the downstream direction and finally forms a circular outlet 31*a*.

The motor support 32 is positioned at the center portion of the outlet 31a and holds the axial flow fan 10 and the motor 20 for driving the axial flow fan 10. The motor support 32 is circular band-shaped in accordance with the shape of the hub 11 of the axial flow fan 10 and the shape of the motor 20.

As shown in FIG. 3, the stator vanes 35 are radially arranged between the motor support 32 and the housing 31 and connect the motor support 32 to the housing 31. The stator vanes 35 serve to guide the three directional airflow generated by the axial flow fan 10 to the axial direction, thereby improving the blowing efficiency of the fan and reducing blowing noise.

Figure 5:
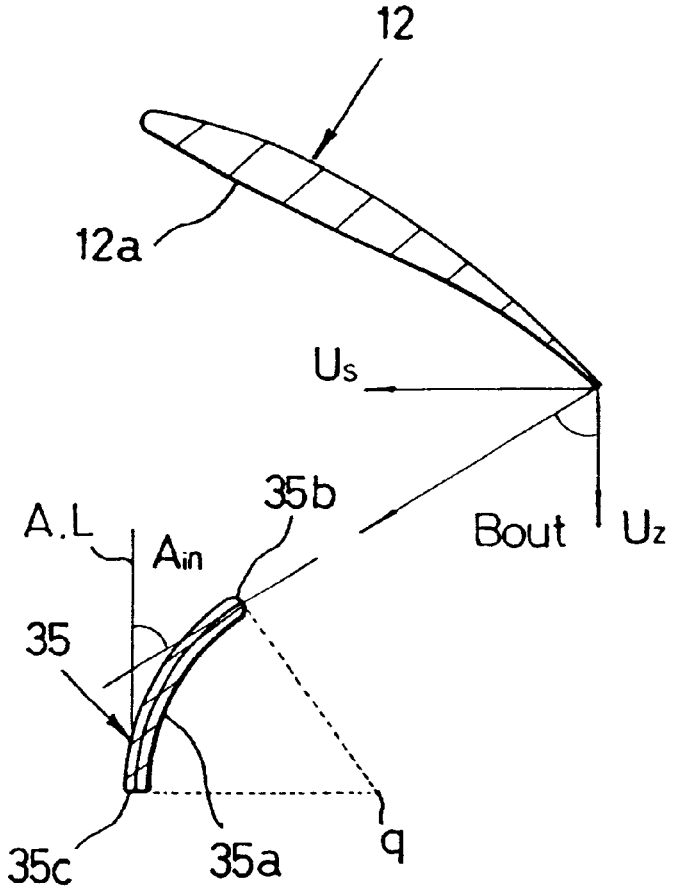
FIG. 5 is a cross section showing the vane and blade of the shrouded axial flow fan assembly according to the first embodiment.

As shown in FIG. 5, the cross section of each of the stator vanes extended from a leading edge 35*b* to a trailing edge 35*c* is curved with respect to the axial direction, thereby allowing airflow to be bent along the airflow guide surface 35*a* of each of the stator veins 35. In addition, as shown in FIG. 3, the stator vanes are curved with respect to the radial direction to introduce three-directional airflow effectively and guide the airflow toward the axial direction, thus improving the blowing efficiency of the fan and reducing noise.

The structure and function of the stator vanes is 25 described in the following in more detail.

(1) First of all, each of the stator vanes 35 is curved with respect to the radial direction so as to introduce the drawn airflow. Therefore, the leading edge line defined by the line joining the leading edges of each vane is curved with respect to the radial line defined by the radially, straightly extended line.

Figure 6:
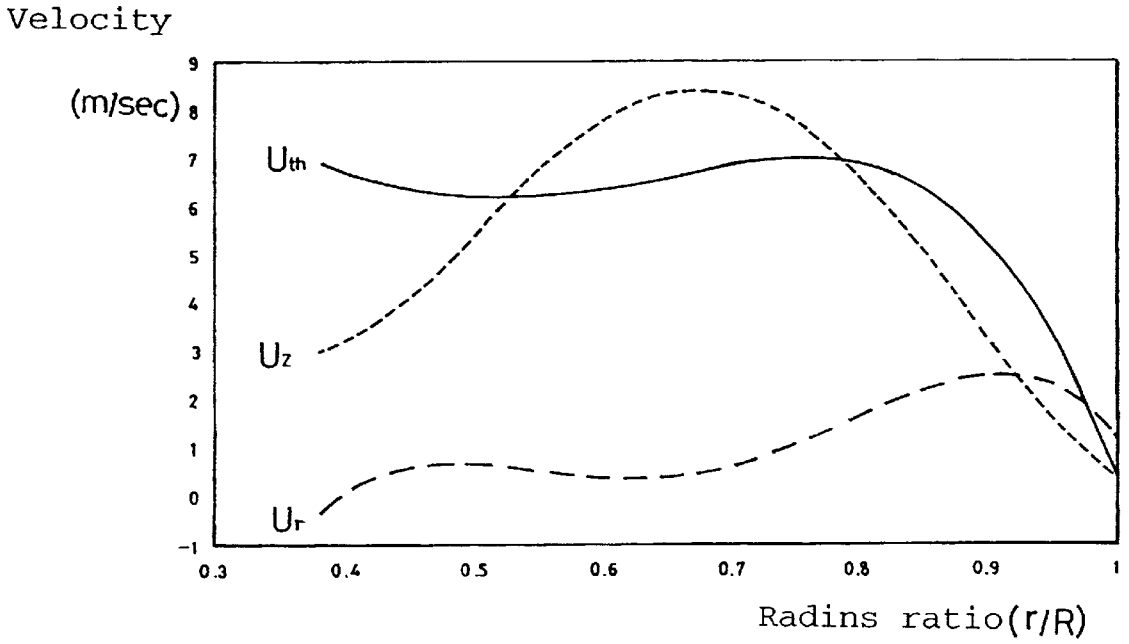
FIG. 6 is a graph showing variations in directional velocity components with respect to the positions of an air particle in the radial line.
Figure 7:
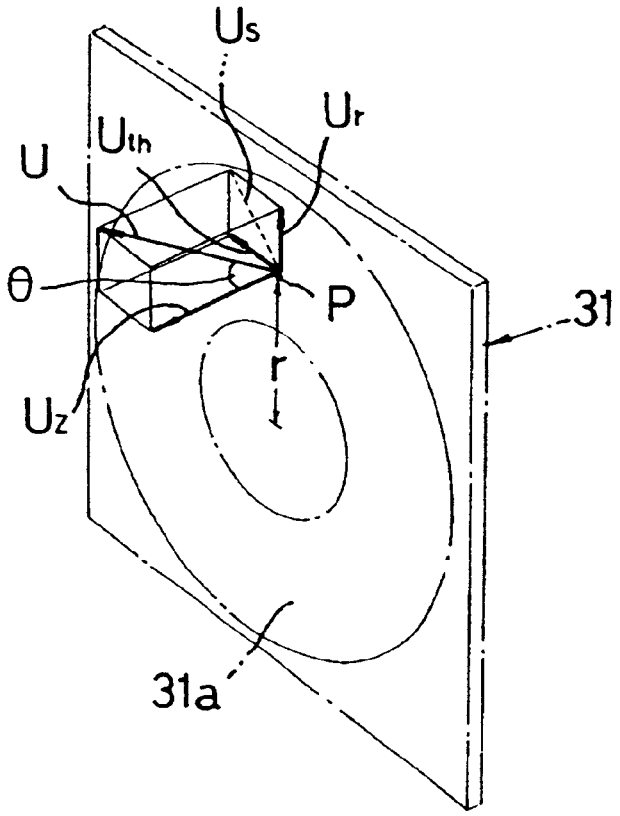
FIG. 7 is a perspective view showing the directional velocity components of an air particle situated at the position spaced apart from the central axis of the fan assembly by the distance of r.

As shown in FIG. 7, the air particle that passes through the position P spaced apart from the axial line of the axial fan by the distance r along the radial direction is moved by the axial flow fan 10 and has an axis-directional velocity component $U_z$, a rotation-directional velocity component $U_{th}$ and a radius-directional velocity component $U_r$. As shown in FIG. 6, the magnitudes of the velocity components depend upon the design of the blades of the axial flow fan.

As described above, since the airflow moved by the axial flow fan 10 should have the radius-directional velocity component $U_r$ as well as the axis-directional velocity component $U_z$ and the rotation-directional velocity component $U_{th}$, the velocity vector U of the air particle of the airflow at the position P is the sum vector of the axis-directional velocity component $U_z$, the rotation-directional velocity component Uth and the radius-directional velocity component $U_r$, as shown in FIG. 7. When the sum vector of the radius-directional velocity component $U_r$ and the rotation-directional velocity component $U_{th}$ is $U_s$, the velocity vector U of the air particle forms the angle θ of $Tan^{-1}(U_s/U_z)$ with the axial line A.L. This means that the since the air particle at the position P has the velocity component $U_s$, the air particle is moved in the direction oblique toward the rotational direction and the radial direction with respect to the axial line A.L.

Figure 8:
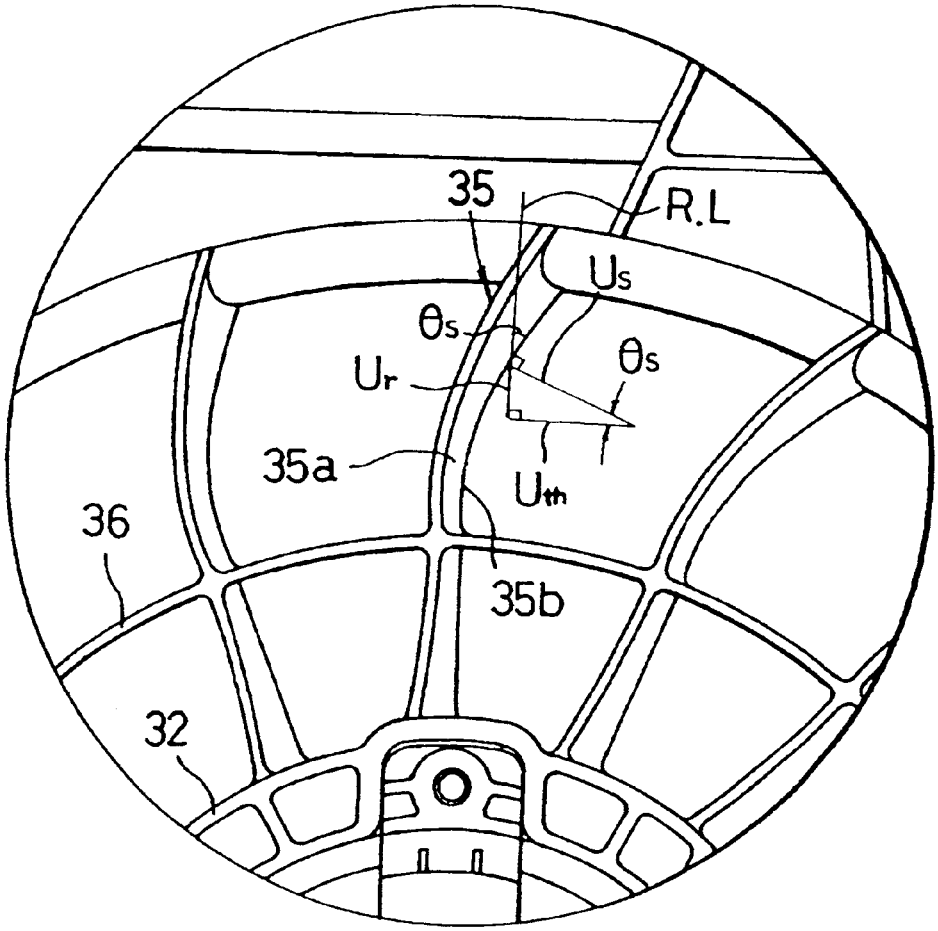
FIG. 8 is an enlarged perspective view showing the shapes of the stator vanes of the fan assembly of the first embodiment.
Figure 9A:
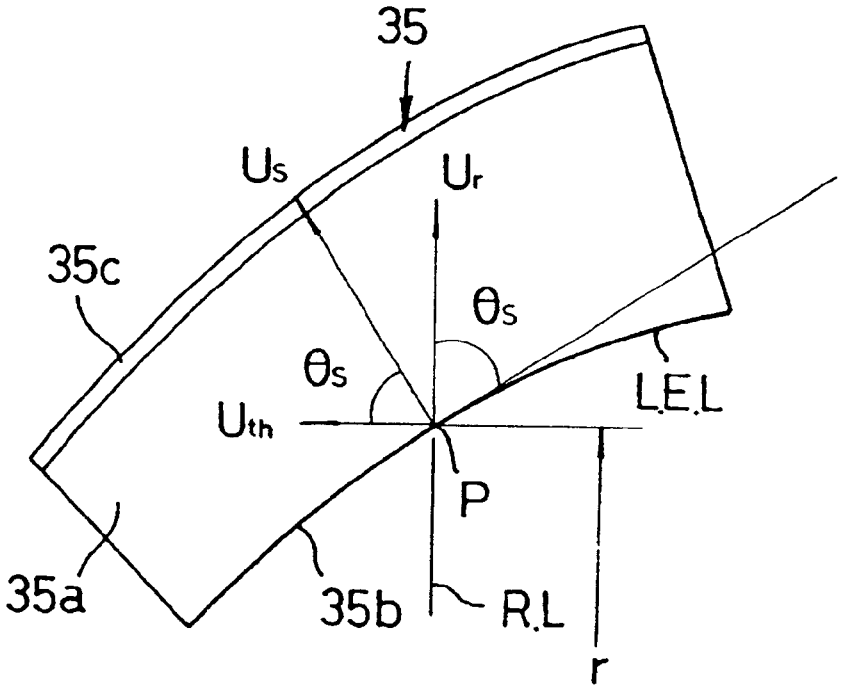
FIG. 9*a* is an enlarged view showing the stator vane of the present invention and the velocity of an air particle.
Figure 9B:
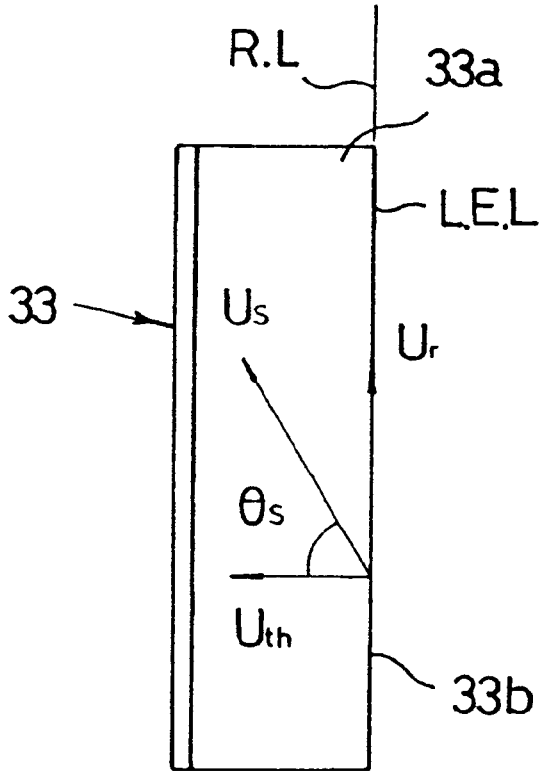
Fig. 9b PRIOR ART
FIG. 9*b* is an enlarged view showing the conventional stator vane and the velocity of an air particle.
Figure 10:
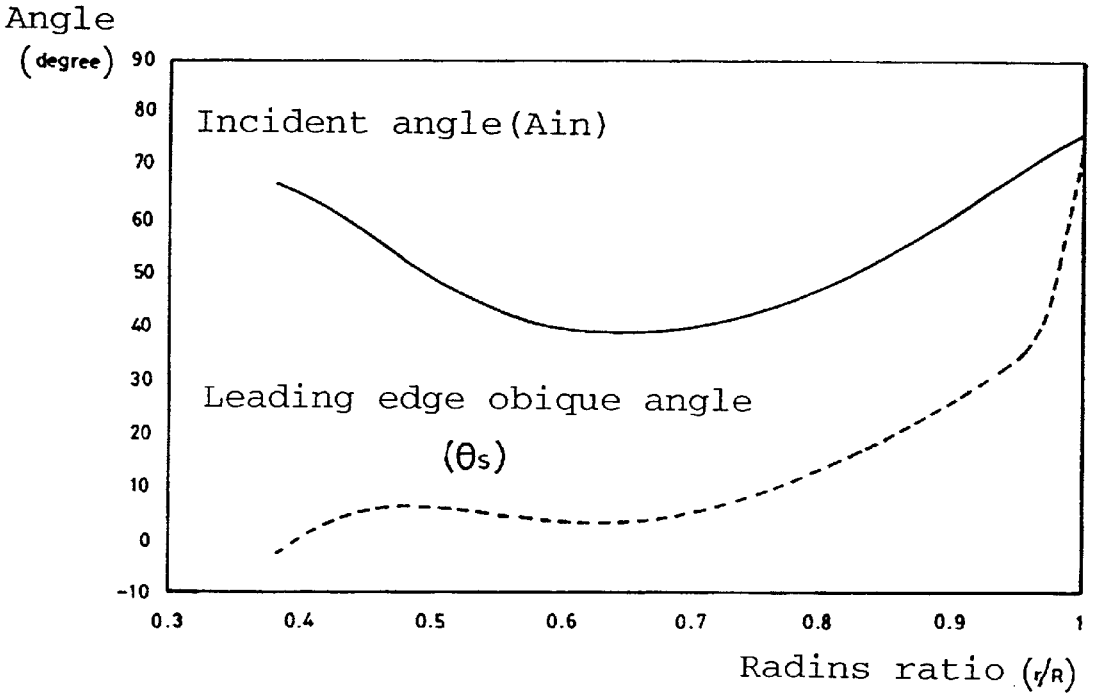
FIG. 10 is a graph showing variations in incident angle and oblique angle of the leading edge side with respect to positions of each vane in the radial direction.

Coping with the situation, each of the stator vanes 35 is axially and radially curved so that a tangent to the curve of each leading edge is perpendicular to the oblique velocity component $U_s$ at the intersection of the oblique velocity component and the tangent, so as to receive oblique airflow effectively. That is, as shown in FIG. 8, each of stator vanes 35 is curved so that a tangent line at each of positions in the leading edge line forms the angle $\theta_s$ of $Tan^{-1}(U_r/U_{th})$ with the radial line R.L., the oblique velocity component $U_s$ forming the angle $\theta_s$ of $Tan^{-1}(U_r/U_{th})$ with the rotation-directional velocity component $U_{th}$. As a whole, each of the stator vanes 35 is curved, with its middle portion protruding toward the direction of rotation. As shown in FIG. 9*a,* since the stator vanes 35 are curved in such a way, the vanes 35 may receive air particles at each of the positions of the leading edge line effectively, thus improving the blowing efficiency of the axial flow fan 10. This effect is well understood from FIG. 9*b* in which the oblique velocity component $U_s$ of an air particle does not form a right angle with the leading edge of the conventional vane 33 because each of the conventional stator vanes 33 extends straightly along the radial direction.

The angle $\theta_s$, which is formed by a tangent at a leading edge and a radial line passing through the leading edge, may be referred to as a leading edge oblique angle.

On the other hand, differing from that of this embodiment, the blade 12 of the axial flow fan 10 may has a forward curvature or a rearward curvature, thereby causing the radius-directional velocity component to have a minus value, that is, generating airflow moved toward the radially inward direction. In such a case, the stator vane 35 should be designed to allow the leading edge line L.E.L to form the leading edge oblique angle $\theta_s$ of a negative value, so that the guide stator vane has a rearward curvature.

Meanwhile, the portion of the stator vane 35, situated within a predetermined radial area around the central axis, is not curved but is extended straightly in the radial direction. In the predetermined radial area around the central axis, the velocity of the airflow is small and, consequently, the leading edge oblique angle $\theta_s$ is small. Therefore, since the achievement of a simple shape for an easy manufacture is more beneficial than the achievement of trivial improvement in blowing efficiency, the portion of the vane is preferably not curved. However, when the radius-directional velocity component in the area may not be disregarded, the portion of the stator vane in the area should be designed to be curved.

(2) Next, the airflow guide surface 35*a* of the stator blade of this invention arcuated in its cross section is described in the following.

As shown in FIG. 5, the airflow guide surface 35*a* of the stator vane 35 of this invention serves to curve the entering air having the oblique velocity component toward the axial direction. To this end, the airflow guide surface 35*a* is designed to be arcuated so that the incident angle $A_{in}$ of the guide surface 35*a* is equivalent to the discharge angle $B_{out}$ of airflow from the fan blade 12 and the projection angle $A_{out}$ of the guide surface 35*a* is zero (that is, $A_{out}$=0). The airflow guide surface 35*a* of each of the stator vanes 35 is circulary arcuated from the leading edge 35*b* to the trailing edge 35*c* in its cross section.

For example, as shown in FIG. 5, airflow discharged by the axial flow fan 10 enters the leading edge 35*b* of the stator vane 35*b,* which is spaced apart from the central axis by the distance r, at a discharge angle $B_{out}$ of $Tan^{31\ 1}(U_s/U_z)$ that the velocity vector of the discharged air forms with the axial line A.L. Therefore, the leading edge side of the stator vane 35 is oriented so as to form an angle $A_{in}$ equivalent to the discharge angle $B_{out}$ with the axial line A.L, while the trailing edge side of the stator vane 35 is oriented so as to be parallel to the axial line A.L. The airflow guide surface 35*a* between the leading edge 35*b* and the trailing edge 35*c* has the same curvature as that of the circle, the circle having as its center a point P at which the normals of the leading edge 35*b* and the trailing edge 35*c* meet and having as its radius the distance between the point P and the leading edge 35*b*. This curvature of the guide surface 35*a* minimizes the generation of vortices, thereby allowing air to flow smoothly along the guide surface 35*a*. In brief, the airflow guide surface 35*a* of the stator vanes according to the present invention receives the air parallel, curves it smoothly and discharges it in the axial direction.

As described above, according to the above-described structure of the stator vanes 35, the air generated by the axial flow fan 10 is introduced parallel to the airflow guide surface 35*a,* is smoothly curved toward the axial direction along the airflow guide surface 35*a* and is blown through the trailing edge 35*c*. Since the airflow generated by the axial flow fan 10 may come to flow in an axial direction due to the conversion of its rotation-directional velocity components Uth and its radius-directional velocity components $U_r$ to the axis-directional velocity components by means of the stator vanes 35, the flow rate of the air in the axial direction is improved and, consequently, the blowing efficiency of the fan is improved. Especially, with regard to the pusher-type fan positioned in front of the heat exchanger, the flow-through rate of the air with regard to the radiation fins of the heat exchanger is high, thus improving the blowing efficiency more.

Figure 11:
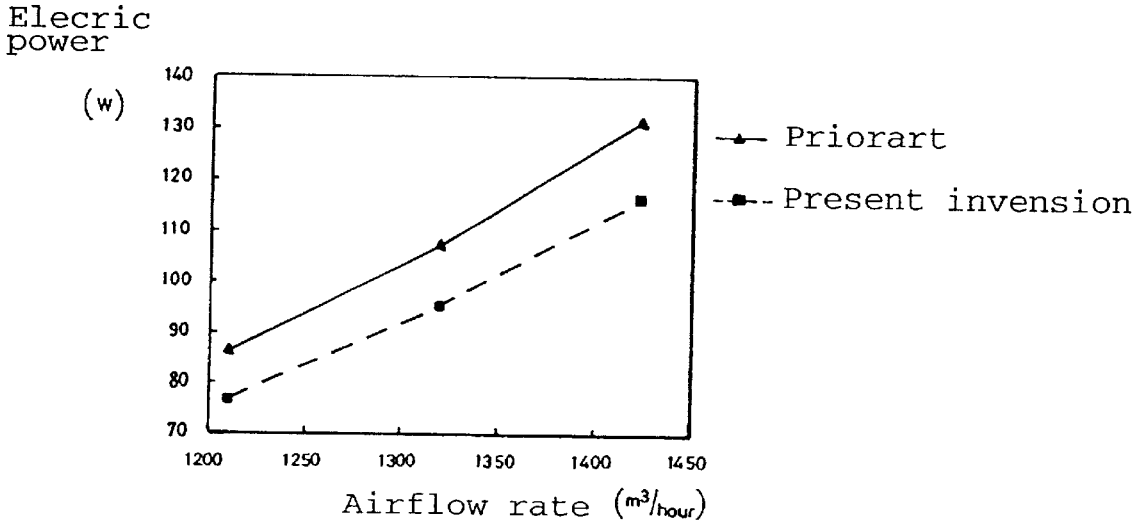
FIG. 11 is a graph comparing consumed power variations of the fan assemblies of the prior art and the present invention with regard to airflow rates.
Figure 12:
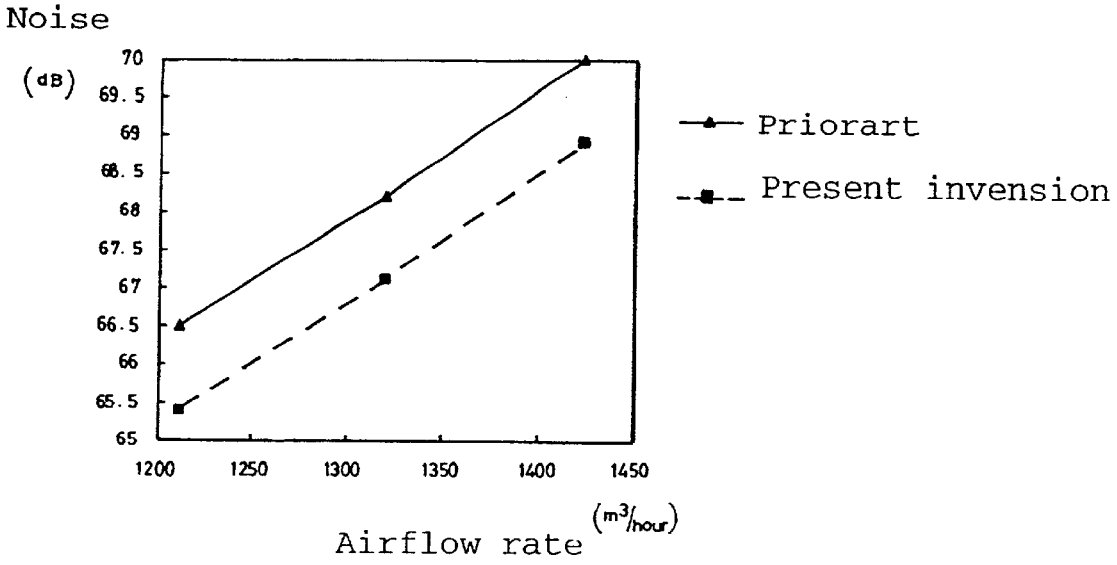
FIG. 12 is a graph comparing noise variations of the fan assemblies of the prior art and the present invention with regard to airflow rates.
Figure 13:
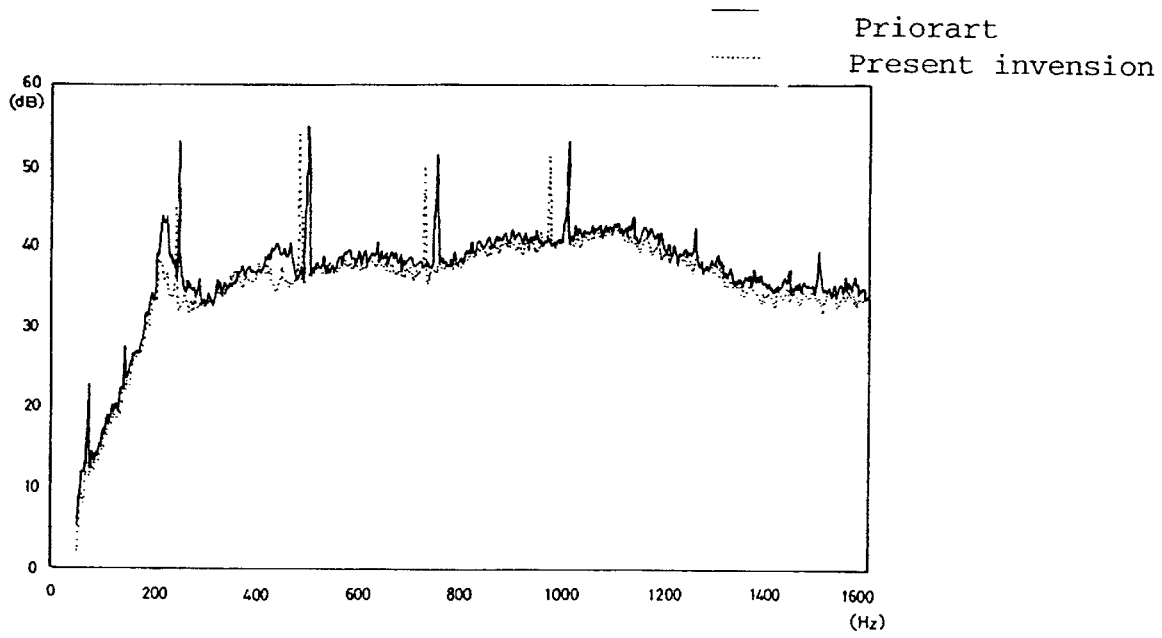
FIG. 13 is a noise spectrum comparing noise variations of the fan assemblies of the prior art and the present invention with regard to frequencies.

According to the results of experiments, as shown in FIGS. 11 and 12, the consumed electric power per airflow rate is reduced by 12–15% and the magnitude of noise per airflow rate is reduced by 1–1.5 dB, compared with the conventional shroud. Additionally, referring to the experimental data of FIG. 13 regarding noise spectrum, the noise with respect to each frequency is smaller compared with the conventional shrouded axial flow fan assembly.

In brief, according to the shrouded axial flow fan assembly, the consumed electric power per the flow rate may be reduced largely and reduce noise, also.

[EMBODYMENT 2]

Figure 14:
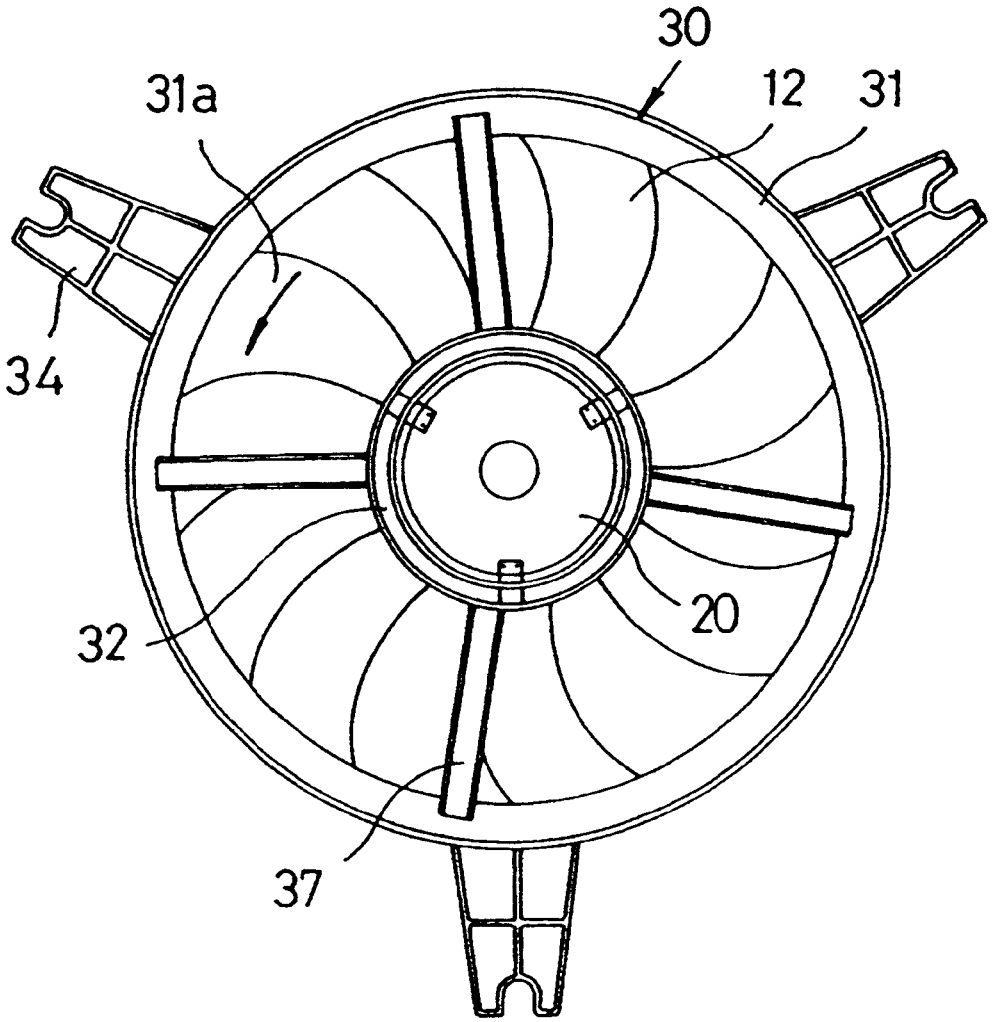
FIG. 14 is a front view showing a shrouded axial flow fan assembly according to a second embodiment of the present invention.
Figure 15:
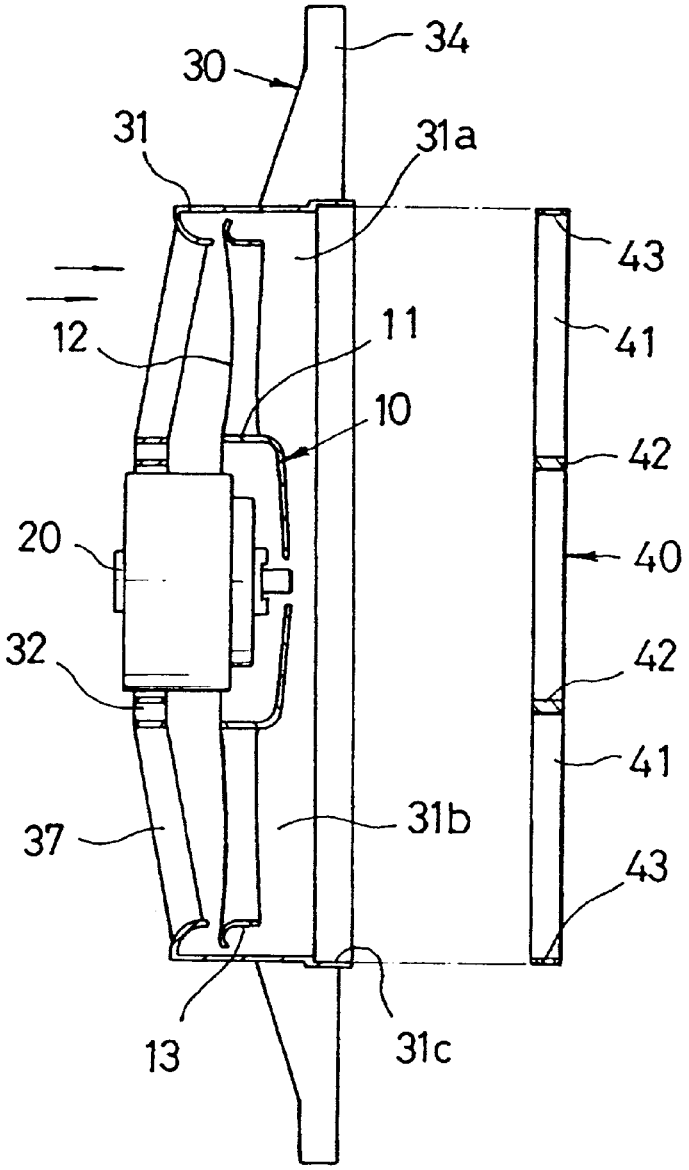
FIG. 15 is a partially exploded cross section showing the second embodiment.

FIG. 14 illustrates a shrouded axial flow fan assembly according to Embodiment 2. The shrouded axial flow fan assembly is provided with a detachable stator 40. The detachable stator vanes 40 and the other parts are assembled together into the shrouded axial flow fan assembly illustrated in FIGS. 14 and 15.

Figure 16:
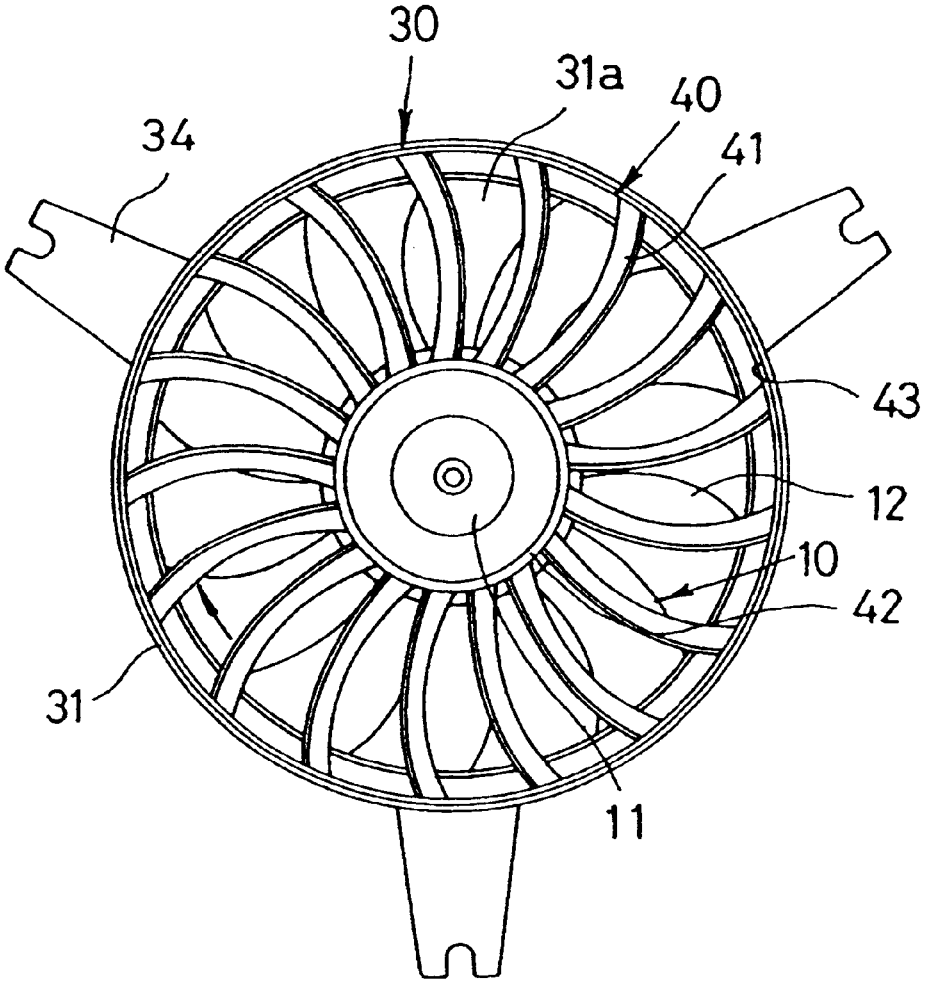
FIG. 16 is a rear view showing a shrouded axial flow fan assembly according to the second embodiment of the present invention.

The shrouded axial flow fan of this embodiment is like that of the previous embodiment except that the shrouded axial flow fan assembly is provided with the detachable stator 40 as a separate part. That is, as shown in FIG. 16, the detachable stator 40 is a distinct part separated from a shroud 40 with the radially inner ends of the vanes 41 of the stator 40 being fixed to the center ring 42 of the stator 40 and the radially outer ends of the vanes 41 of the stator 40 being fixed to the outer frame 43 of the stator 40. The stator 40 is detachably fitted into a mount groove 31*c* that is formed in the housing 31 of a shroud 30. In the meantime, each of the vanes 41 of the stator 40 is curved so that its middle portion is protruded toward the circumferential direction and has an airflow guide surface arcuated from its leading edge to its trailing edge, in the same manner as that of the previous embodiment. As a result, the present embodiment has the same effect as that of the previous embodiment. Additionally, the stator 40 may be attached to and detached from the shroud 30 as occasion demands.

As described above, the present invention provides an airflow guide stator vane for axial flow fans and a shrouded axial flow fan assembly having such airflow guide stator vanes, capable of improving the blowing efficiency by converting the radius-directional velocity components as well as the rotation-directional velocity components of airflow generated by an axial flow fan to the axis-directional velocity components by its airflow guide surface, thus allowing a low output motor to be used for the fan and reducing the consumed power for driving the axial flow fan and noise generated by the driving of the axial flow fan.

According to another embodiment, the present invention provides a shrouded axial flow fan assembly having detachably airflow guide stator vanes, allowing its stator to be attached to and detached from its shroud as occasion demands and producing the same effect as that of a single structure shroud.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An airflow guide stator vane for use with a axial flow fan that produces airflow, the stator vane comprising:

a leading edge;

a trailing edge; and an airflow guide surface extending from the leading edge to the trailing edge and arcuately shaped and configured to guide the air flow toward the axial direction of the axial flow fan;

wherein the stator vane is axially and radially curved so that a tangent to the curve of the leading edge is perpendicular to an oblique velocity component of the air flow which is a sum vector of a rotation-directional velocity component and a radius-directional component of an air particle of the airflow at the intersection of the oblique velocity component and the tangent.

2. The vane according to claim 1, wherein said airflow guide surface is configured so that the incident angle of the guide surface is equivalent to a discharge angle of the airflow from the axial flow fan, an he projection angle of the guide surface is zero.

3. An axial flow fan assembly, comprising:

an axial flow fan that produces airflow and comprising a central hub and a plurality of blades radially arranged along a circumference of the hub, the central hub being adapted to be connected to a driving shaft of a motor for driving the axial flow fan; and a shroud comprising:

a housing surrounding the peripheral ends of said axial flow fan, a motor support holding the motor, and a plurality of airflow guide stator vanes arranged between said housing and said motor support, each stator vane comprising a leading edge, a trailing edge and an airflow guide surface, the airflow guide surface extending from the leading edge to the trailing edge and arcuately shaped, and configured to guide the air flow toward the axial direction of the axial flow fan;

wherein each stator vane is axially and radially curved so that a tangent to the curve of each leading edge is perpendicular to an oblique velocity component of the air flow which is a sum vector of a rotation-directional velocity component and a radius-directional component of an air particle of the airflow at the intersection of the oblique velocity component and the tangent.

4. The assembly according to claim 3, wherein said axial flow fan is positioned in front of a heat exchanger.

5. The assembly according to claim 3, wherein said axial flow fan is positioned behind a heat exchanger.

6. The assembly according to claim 3, wherein said airflow guide surface is configured so that an incident angle of the guide surface is equivalent to an entering angle of the airflow and a projection angle of the guide surface is zero.

7. The assembly according to claim 6, wherein said stator vanes comprise a detachable vane configured such that a radially inner end of said vane is fixed to a center ring and a radially outer end of the vane is fixed to an outer frame.

8. The assembly according to claim 7, wherein said housing is provided with a mount groove at its rear portion.

* * * * *